US010220425B2

(12) United States Patent
Weinzierl

(10) Patent No.: US 10,220,425 B2
(45) Date of Patent: Mar. 5, 2019

(54) METHOD FOR COOLING SHEET METAL BY MEANS OF A COOLING SECTION, COOLING SECTION AND CONTROL DEVICE FOR A COOLING SECTION

(75) Inventor: Klaus Weinzierl, Nürnberg (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 933 days.

(21) Appl. No.: 13/581,437

(22) PCT Filed: Feb. 4, 2011

(86) PCT No.: PCT/EP2011/051663
§ 371 (c)(1),
(2), (4) Date: Aug. 27, 2012

(87) PCT Pub. No.: WO2011/104103
PCT Pub. Date: Sep. 1, 2011

(65) Prior Publication Data

US 2012/0318478 A1 Dec. 20, 2012

(30) Foreign Application Priority Data

Feb. 26, 2010 (EP) ..... 10154802

(51) Int. Cl.
*F28D 15/00* (2006.01)
*B21B 37/76* (2006.01)
(Continued)

(52) U.S. Cl.
CPC ..... *B21B 37/76* (2013.01); *C21D 1/667* (2013.01); *C21D 11/005* (2013.01); *B21B 37/28* (2013.01);
(Continued)

(58) Field of Classification Search
CPC ..... C22C 21/10; C22F 1/042; C22F 1/04
(Continued)

(56) References Cited

U.S. PATENT DOCUMENTS 8,369,979 B2 2/2013 Weinzierl ..... 700/153
2007/0175548 A1 8/2007 Hensger et al. ..... 148/541
(Continued)

FOREIGN PATENT DOCUMENTS

CN 101489696 A 7/2009 ..... B21B 37/46
DE 19520138 A1 12/1996 ..... C21D 1/60
(Continued)

OTHER PUBLICATIONS

Chinese Office Action Application No. 20118001188.4, 11 pages, dated Dec. 31, 2013.
(Continued)

*Primary Examiner* — Jenny R Wu
(74) *Attorney, Agent, or Firm* — Slayden Grubert Beard PLLC

(57) ABSTRACT

A method is provided for cooling sheet metal using a cooling section having multiple coolant dispensing devices for cooling upper and lower faces of a sheet metal. The cooling achieves a predefined target state of the sheet metal at a reference point at and/or after the exit from the cooling section, wherein coolant dispensing for a first and a second coolant dispensing device is determined, wherein the first and the second coolant dispensing devices are arranged opposite the sheet metal. Because the coolant dispensing for the first and second coolant dispensing devices is determined based on a predefined flow of heat to be dissipated from the sheet metal side that faces the respective coolant dispensing device, with a surface temperature of the respective sheet metal side being taken into account, the flatness of plate that is produced can be increased further with a simultaneously high throughput of the plate rolling train.

13 Claims, 2 Drawing Sheets

(51) Int. Cl.

| | |
|---|---|
| ***C21D 1/667*** | (2006.01) |
| ***C21D 11/00*** | (2006.01) |
| *B21B 37/28* | (2006.01) |
| *B21B 38/00* | (2006.01) |
| *B21B 38/02* | (2006.01) |
| *B21B 45/02* | (2006.01) |
| *C21D 9/46* | (2006.01) |

(52) U.S. Cl.
CPC ..... *B21B 38/006* (2013.01); *B21B 38/02* (2013.01); *B21B 45/0218* (2013.01); *B21B 2261/20* (2013.01); *B21B 2263/04* (2013.01); *C21D 9/46* (2013.01)

(58) Field of Classification Search
USPC ..... 148/549, 516
See application file for complete search history.

(56) References Cited

U.S. PATENT DOCUMENTS

| | | | | |
|---|---|---|---|---|
| 2010/0219566 | A1 | 9/2010 | Shimoi et al. | 266/44 |
| 2011/0208345 | A1* | 8/2011 | Soderlund | 700/153 |
| 2012/0318478 | A1 | 12/2012 | Weinzierl | 165/104.11 |

FOREIGN PATENT DOCUMENTS

| | | | | | |
|---|---|---|---|---|---|
| DE | 19943403 | A1 | | 3/2001 | B21B 37/76 |
| EP | 1944099 | A1 | | 7/2008 | B21B 37/74 |
| EP | 2070608 | A1 | | 6/2009 | B21B 37/76 |
| JP | 54075412 | A | | 6/1979 | C21D 1/00 |
| JP | 61253112 | A | | 11/1986 | B21B 37/00 |
| JP | 02179825 | A | * | 7/1990 | |
| JP | 02179827 | A | | 7/1990 | B21B 37/00 |
| JP | 11267738 | A | | 10/1999 | B21B 45/02 |
| JP | 2003293030 | A | | 10/2003 | B21B 45/02 |
| JP | 2004130353 | A | | 4/2004 | B21B 37/00 |
| RU | 2346061 | C2 | | 2/2009 | B21B 45/02 |
| WO | 01/17704 | A1 | | 3/2001 | B21B 37/76 |
| WO | WO 2009024644 | A1 | * | 2/2009 | |
| WO | 2009/106423 | A1 | | 9/2009 | B21B 37/76 |
| WO | 2011/104103 | A2 | | 9/2011 | B21B 37/76 |

OTHER PUBLICATIONS

Chinese Office Action, Application No. 2011800111884, 14 pages, dated Aug. 5, 2014.

European Search Report, Application No. 10154802.2-2302, 4 pages, dated Oct. 20, 2010.

International Search Report and Written Opinion, Application No. PCT/EP2011/051663, 7 pages, dated Nov. 9, 2011.

Galant, Hubert et al., "CRM Data—The Mulpic Cooling Process—a Year's Experience with the Plate Line at Forges de Clabecq," Stahl u. Eisen 105 Nr. 22, pp. 1191-1194 (8 pages) (German Language w/ English translation), Nov. 4, 1985.

Streiβelberger, Alois et al., "The Process of ™-Treatment with Accelerated Cooling for the Manufacture of Heavy Plate from Constructional Steels," Stahl und Eisen, vol. 5, Verlag Stahleisen MbH, pp. 65-73 (18 pages) (German Language w/ English translation), Nov. 15, 1990.

Siemens Vai, "Siroll$^{CIS}$ MULPIC Plate Cooling Technology—AC and DQ Cooling for Advanced Material Properties," Metals Technologies, 8 pages, 2009.

* cited by examiner

METHOD FOR COOLING SHEET METAL BY MEANS OF A COOLING SECTION, COOLING SECTION AND CONTROL DEVICE FOR A COOLING SECTION

CROSS-REFERENCE TO RELATED APPLICATIONS

This application is a U.S. National Stage Application of International Application No. PCT/EP2011/051663 filed Feb. 4, 2011, which designates the United States of America, and claims priority to EP Patent Application No. 10154802.2 filed Feb. 26, 2010. The contents of which are hereby incorporated by reference in their entirety.

TECHNICAL FIELD

This disclosure relates to a method for cooling sheet metal, especially heavy plate, by means of the cooling section, wherein the cooling section has a plurality of coolant dispensing devices for cooling an upper sheet metal face and a plurality of coolant dispensing devices for cooling a lower sheet metal face, wherein a predefined target state of the sheet metal is achieved by means of the cooling at a reference point at and/or after the exit from the cooling section, wherein coolant dispensing for a first and a second coolant dispensing device is determined, wherein the first and the second coolant dispensing devices are disposed opposite one another relative to the sheet metal. The disclosure further relates to a method for cooling sheet metal by means of the cooling section, wherein the cooling section has a plurality of coolant dispensing devices for cooling an upper sheet metal face and a plurality of coolant dispensing devices for cooling a lower sheet metal face, wherein a predefined target state of the sheet metal is achieved by means of the cooling at and/or after the exit from the cooling section, wherein coolant dispensing is determined for a least one of the coolant dispensing devices. In addition the disclosure relates to a control and/or regulation device for the cooling section.

The disclosure lies in the technical area of rolling trains, especially heavy plate rolling trains, e.g., the cooling of heavy plate.

BACKGROUND

The cooling or the operation of the cooling section has a decisive effect on the quality and the properties of the sheet metal produced. The cooling section of a heavy plate train is used especially to set the material properties of the sheet metal in the desired way.

During cooling of heavy plate, because of the comparatively large thickness and the heat content associated therewith, deviation from flatness can occur during the cooling, which is caused by thermal stresses. These thermal stresses can be influenced by the operation of the cooling section. The aim is always to manufacture a flat sheet metal, which exhibits the desired mechanical properties.

Heavy plate as a rule has a thickness of 3 mm or more and thus fulfils the definition in accordance with EN 10029.

A method for cooling heavy plate is known from European patent application EP 2070608 A1. Here the coolant dispensing of the control elements above and below the sheet metal is set individually, especially such that the same coefficient of thermal transfer is present for the upper face of the sheet metal and the lower face of the sheet metal. The disadvantage of this is that despite the comparatively exact determination of the heat transfer coefficients, deviation from flatness in the cooling section can still occur. Also deviations from flatness of the sheet metal which have already occurred before the cooling section could not be rectified with this method.

SUMMARY

In one embodiments, a method for cooling sheet metal by means of a cooling section is provided, wherein the cooling section has a plurality of coolant dispensing devices for cooling an upper sheet metal face and a plurality of coolant dispensing devices for cooling a lower sheet metal face, wherein by means of the cooling a predetermined target state of the sheet metal is reached at a reference point at and/or after exit from the cooling section, wherein coolant dispensing is determined for a first and a second coolant dispensing device, wherein the first and the second coolant dispensing device are arranged opposite one another relative to the sheet metal, wherein the coolant dispensing is determined for the first and the second coolant dispensing device with reference to a predetermined flow of heat to be dissipated from the side of the sheet metal facing towards the respective coolant dispensing device, wherein a temperature, especially surface temperature of the respective side of the sheet metal is to be taken into account for the flow of heat to be dissipated in each case.

In a further embodiment, a ratio of the flow of heat to be dissipated from upper sheet metal face to lower sheet metal face is set as a function of a flatness of the sheet metal, especially on entry into the cooling section. In a further embodiment, for a flat sheet metal, especially a sheet metal that is flat on its entry into the cooling section, the ratio is essentially equal to one. In a further embodiment, for a non-flat sheet metal, especially a sheet metal that is not flat on entry into the cooling section, the ratio is set such that the non-flatness of the sheet metal after its passage through the cooling section is reduced relative to the non-flatness of the sheet metal before its passage through the cooling section. In a further embodiment, the coolant is dispensed by the first and second coolant dispensing device on the basis of the equation:

$$0=x\cdot j_{upper}-(1-x)\cdot j_{lower}$$

and $$j_{tot}=j_{upper}+j_{lower}$$

wherein x: is a predeterminable factor between 0 and 1, $j_{upper}$: is a flow of heat to be dissipated from the upper side of the sheet metal, $j_{lower}$: is a flow of heat to be dissipated from the lower side of the sheet metal, and $j_{tot}$: is a total flow of heat to be dissipated and predetermined.

In a further embodiment, for at least one of the coolant dispensing devices, the coolant is dispensed independently of the coolant dispensing of another coolant dispensing device, especially of a coolant dispensing device lying opposite it relative to the sheet metal. In a further embodiment, the determination is undertaken such that the sheet metal is essentially divided virtually in parallel to the upper face or the lower face into a first sheet metal and a second sheet metal, wherein the coolant dispensing is determined in each case separately for the first and the second sheet metal, wherein for the respective determination the exchange of heat between the first sheet metal and the second sheet metal is ignored. In a further embodiment, an individual timing curve for a variable describing an energetic state of the sheet metal is determined for the first sheet metal and the second sheet metal respectively, on the basis of which a flow of heat to be dissipated for the respective upper sheet metal face and the lower sheet metal face is determined. In a further embodiment, during the determination of the coolant dispensing, account is taken of the fact that during its passage through the cooling section the temperature of the upper sheet metal face and/or the temperature of the lower sheet metal face is in each case always greater than or equal to a predetermined limit temperature, especially 350° C.

In another embodiment, a method for cooling sheet metal by means of a cooling section is provided, wherein the cooling section has a plurality of coolant dispensing devices for cooling an upper sheet metal face and a plurality of coolant dispensing devices for cooling a lower sheet metal face, wherein by means of the cooling a predetermined target state of the sheet metal is reached at least during and/or after exit from the cooling section, wherein a coolant dispensing is determined for at least one of the coolant dispensing devices, wherein, when the coolant dispensing is determined for at least one of the coolant dispensing devices account is taken of the fact that that side of the sheet metal, which faces towards this coolant dispensing device, especially while the cooling is being carried out, always has a temperature greater than or equal to a predetermined limit temperature.

In another embodiment, a control and/or regulation device for a cooling section is provided, with a machine-readable program code, which includes control commands which cause the control and/or regulation device, when said code is executed, to carry out a method including any of the steps disclosed above.

In another embodiment, machine-readable program code for a control and/or regulation device for a cooling section is provided, wherein the program code includes control commands which cause the control and/or regulation device to carry out a method including any of the steps disclosed above. In another embodiment, a non-transitory storage medium storing such a machine-readable program code is provided.

In another embodiment, a cooling section for cooling sheet metal is provided, wherein the cooling section comprises a plurality of coolant dispensing devices for cooling an upper sheet metal face and a plurality of coolant dispensing devices for cooling a lower sheet metal face, with a control and/or regulation device as disclosed above, wherein the coolant dispensing devices are actively connected to the control and/or regulation device and are able to be controlled and/or regulated by the latter.

BRIEF DESCRIPTION OF THE DRAWINGS

Example embodiments will be explained in more detail below with reference to figures, in which.

DETAILED DESCRIPTION

Figure 1:
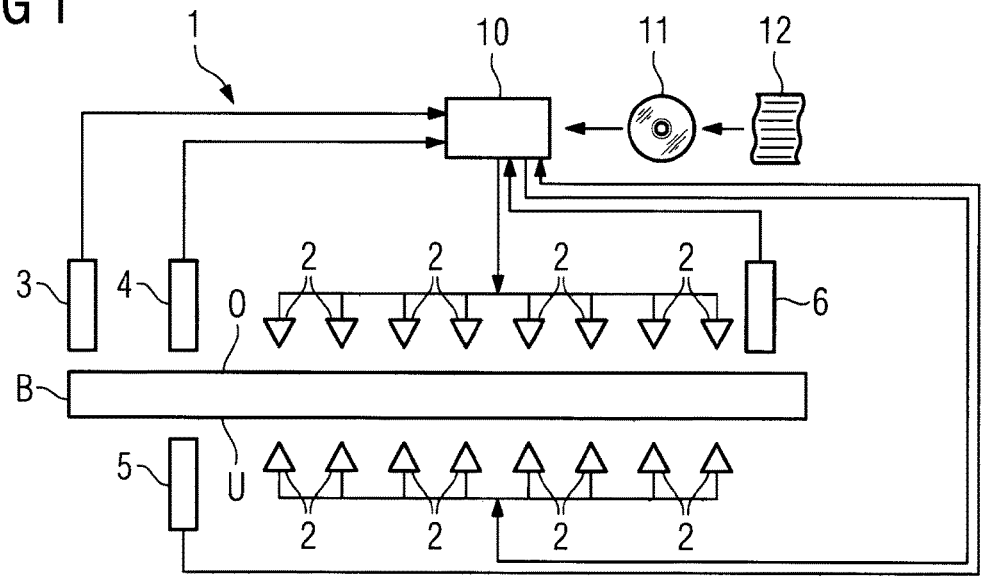
FIG. 1 shows a schematic diagram of a cooling section for cooling heavy plate with a plurality of coolant dispensing devices.

Some embodiments disclosed herein increase the flatness of manufactured heavy plate during the manufacturing of heavy plate with a simultaneous high throughput of the heavy plate train.

For example, some embodiments provide a method for cooling sheet metal by a cooling section, wherein the cooling section has a plurality of coolant dispensing devices for cooling an upper face of the sheet metal and a plurality of coolant dispensing devices for cooling a lower face of the sheet metal, wherein a predetermined target state of the sheet metal is achieved by means of the cooling at a reference point, especially at the latest at and/or after exit from the cooling section, wherein a coolant dispensing for a first and a second coolant dispensing device is determined, wherein, relative to the sheet metal, the first and the second coolant dispensing device are arranged opposite one another, wherein the determination of the coolant dispensing occurs for the first and second coolant dispensing device on the basis of the predetermined flow of heat to be dissipated from the side of the sheet metal facing towards the respective coolant dispensing device, whereby for the respective the flow of heat to be dissipated, a temperature, especially a surface temperature of the respective face of the sheet metal is taken into account.

It has been discovered that, for maintaining flatness as well as possible, it is not sufficient merely to take account of the coefficients of thermal transfer for upper face and lower face and to synchronize these with one another.

Instead sheet metal which is as flat as possible may be achieved for example if—with flat sheet metal entering the section—the flow of heat for upper face and lower face is the same. For this however the temperature of the upper face and the lower face must be explicitly taken into consideration, since this directly influences the flow of heat able to be dissipated. In conventional systems the aim instead is to make the coefficients of thermal transfer for upper face and lower face the same. With different temperatures of sheet metal upper face and sheet metal lower face however this leads precisely to an uneven flow of heat for upper and lower face, which for flat sheet metal entering the section can effect deviations in flatness. This can be avoided by embodiments disclosed herein.

The temperature of the upper sheet metal face or lower sheet metal face can be determined by means of a measurement, by means of a pyrometer for example. As an alternative calculated actual temperatures or known for example from a sheet metal following calculation, can also be included.

Coolant dispensing is to be understood both as the dispensing of a quantity of the coolant per unit of time and also as the manner in which the coolant is dispensed, for example the setting of the angle of application etc . . . . Frequently only the quantity of coolant per unit of time is set.

A device which is embodied to dispense coolant onto the sheet metal is seen as a coolant dispensing device.

The coolant dispensing device can be an individually switchable valve arrangement with one or more coolant outlets. As an alternative this device can also be a plurality of individually switchable valve outlet devices which are jointly controlled or operated. The first-named embodiment may allow a more flexible setting or more flexible operation of the cooling section.

In some embodiments, all coolant dispensing devices of the cooling section both for cooling the lower sheet metal face and also for cooling the upper sheet metal face are embodied as individually switchable valve arrangements with associated coolant outlets.

A desired temperature to be reached can be viewed as the end state for sheet metal or also a desired structure or a desired phase composition of the sheet metal. The end state ensures that a desired product is actually provided by the cooling section of the heavy plate rolling train. If the end state is not achieved the manufactured product is generally of lower value or is to be discarded as scrap.

In one embodiment a ratio of a flow of heat to be dissipated from upper sheet metal face to lower sheet metal face is set as a function of a flatness of the sheet metal, especially on its entry into the cooling section. This makes it possible by means of the cooling section or the cooling to have an effect on the sheet metal such as is needed. In particular the cooling section can have a correcting effect on the flatness of the sheet metal, if necessary. This enables the cooling section to contribute to maintaining the product quality, since on the one hand sheet metal which is already non-flat can be transformed into flat sheet metal, on the other hand sheet metal entering the cooling section in a flat state also exits from the cooling section again in a flat state. The control and/or regulation device for the cooling section can be effectively connected for this purpose to a flatness measuring device before the cooling section so that the cooling section can be controlled and/or regulated accordingly as a function of the detected flatness, especially such that the deviations from flatness of non-flat sheet metal entering the cooling section are reduced and sheet metal entering the cooling section in a flat state remains flat.

In one embodiment, with flat sheet metal, especially sheet metals entering the cooling section in a flat state, the ratio of the flow of heat to be dissipated from the upper face of the sheet metal and the flow of heat to be dissipated from the lower face of the sheet metal is essentially one. I.e. the dissipated heat per unit of time on the upper face is equal to the dissipated heat per unit of time on the lower face. Because of the possibly differing temperatures and the difference in time for which the coolant remains on the sheet metal, especially for upper sheet metal face and lower sheet metal face, this means that a different amount of coolant has to be applied for the upper sheet face and the lower sheet face.

In another embodiment, for non-flat sheet metal the ratio is set such that the non-flatness of the sheet metal is reduced after its passage through the cooling section relative to the non-flatness of the sheet metal before its passage through the cooling section. This not only ensures that a desired product is produced by means of the cooling section but it also enables the quality of the manufactured product in respect of flatness to be influenced by the cooling section. In particular by a correspondingly adapted cooling, i.e. corresponding uneven distribution of the flow of heat for upper sheet metal face and lower sheet metal face, flatness errors of the sheet metal can still be corrected in the cooling section, through which the yield of the heavy plates rolling train might also increase.

It may be advantageous to determine the dispensing of coolant for the first and second coolant dispensing device by means of the following equations:

$$0=x\cdot j_{upper}-(1-x)\cdot j_{lower}$$

and $$j_{tot}=j_{upper}+j_{lower}$$

wherein x: is a predeterminable factor between 0 and 1, wherein this can depend on the flatness of the sheet metal entering the cooling section or a temperature, especially a temperature difference between upper sheet metal face and lower sheet metal face, $j_{upper}$: is a flow of heat to be dissipated from the upper face of the sheet metal, $j_{lower}$: is a flow of heat to be dissipated from the lower face of the sheet metal, and $j_{tot}$: is a total flow of heat to the dissipated and predetermined.

The respective flow of heat can be modeled via an empirical, physical or empirical-physical model. The person skilled in the art can determine this for example with the aid of sheet metal cooled in the past. The model of the flow of heat is as a rule at least one function of the respective temperature of the sheet metal face, the respective temperature of the coolant which is used for cooling, the speed of the sheet metal and also the quantity of coolant. Further parameters can occur for example the speed with which the coolant strikes the surface of the sheet metal.

Based on the above equation system a quantity of coolant can then be determined for a coolant dispensing device in order to set a desired flow of heat.

For determining the coolant dispensing, account may be taken in addition or instead as an ancillary condition that, during its passage through the cooling section, the temperature of the upper sheet metal face and/or the temperature of the lower sheet metal face in each case is always greater than or equal to a predetermined limit temperature, especially 350° C. A surface temperature of the sheet metal is preferably used as the limit temperature. The level of the limit temperature is for example determined such that the cooling effect principle for the overall cooling section is the same. If the cooling effect principle changes for the sheet metal while this is passing through the cooling section the cooling becomes more difficult to manage. For this reason there is provision for operating the cooling section such that this limit temperature is neither undershot by the upper face of the sheet metals nor by the lower face of the sheet metal during its passage through the cooling section. To do this either $j_{tot}$ can be reduced so that the said ancillary condition is taken into consideration (=additional) or the calculated heat flow on the face which would otherwise lead to the value being undershot can be accordingly reduced retrospectively, (=replacement), so that the undershoot does not occur.

For example the limit temperature can be selected from a temperature range of 420° C. to 300° C. In this surface temperature range of the sheet metal—depending on the respective cooling conditions in a cooling section—especially on the upper face, a change of the coolant behavior occurs during the cooling of the sheet metals, which is accompanied by a change to the cooling mechanism or cooling effect principle. This change leads to cooling conditions that are difficult to manage, which means that the sheet metal can exit from the cooling section in a non-flat state. The definition of a limit temperature, below which the upper sheet metal face and/or the lower sheet metal face may not fall, and taking account of this limit temperature in the determination of the coolant dispensing enables it to be ensured that a critical temperature regime barely able to be managed for cooling is avoided during the passage of the sheet metal through the cooling section While the operation of the coolant dispensing devices disposed above and below the sheet metal is linked in the manner described above by using an equation system, as an alternative a separate calculation can be undertaken for coolant dispensing devices disposed above and below the sheet metal.

In an alternative embodiment, for at least one of the coolant dispensing devices, the coolant dispensing is determined independently of the coolant dispensing of another of coolant dispensing device, especially a coolant dispensing device opposite said device relative to the sheet metal.

This is possible since with two-sided heat dissipation in the direction of the thickness of the sheet metal there is at least one point at which the heat flow disappears or is equal to zero. For this point in the thickness direction no exchange of heat occurs. The sheet metal can be divided as required at this point without this altering the results. Thus a calculation of the flow of heat to be dissipated or a quantity of coolant required for this can generally be undertaken for one side adiabatically, i.e. for the calculation in relation to one side, for example the upper face, the interaction with the other side, for example the lower face of the sheet metal, does not have to be taken into account.

The value may be determined by the sheet metal, especially without explicit calculation of the above-mentioned point, being divided virtually in parallel to the upper face or lower face into a first sheet metal and a second sheet metal, wherein the coolant dispensing is determined in each case separately for the first and the second sheet metal, wherein in the respective determination an exchange of heat between the first sheet metal and the second sheet metal is not taken into account.

In other words this means that for the first sheet metal, e.g. the upper sheet metal, the quantity of coolant is determined, wherein for the boundary surface of the first sheet metal facing the second sheet metal, e.g. the lower sheet metal, no exchange of heat is taken into account. Furthermore the coolant dispensing is calculated for the second e.g. the lower sheet metal, wherein no exchange of heat for the boundary surface of the second sheet metal facing the first sheet metal is taken into account. The exchange of heat between the first and the second sheet metal is thus not taken into account in terms of the calculations. This means that an equation is obtained with one unknown which is thus able to be resolved.

The term "virtual" in this context means that the division of the sheet metal is only undertaken from a calculation standpoint. There is thus no actual, i.e. physical, division of the sheet metal.

For the above separate calculation for first sheet metal and second sheet metal the procedure may provide that for the first sheet metal and the second sheet metal, an individual, especially time curve of a variable describing an energetic state of the sheet metal is determined, on the basis of which a flow of heat to be dissipated for the respective upper sheet metal face the lower sheet metal face is determined. An, especially calculated, actual temperature curve, actual enthalpy curve, or a curve of another suitable variable can be used as the variable describing the energetic state. When a time curve is used this is preferably predetermined individually for a plurality of defined sheet metal sections so that the dynamic which is as great as possible is achieved for the cooling and the entire sheet metal continuously exhibits the desired properties.

For determining the coolant dispensing, account may be taken of the fact that during the passage through the cooling section the temperature of the upper sheet metal face and/or the temperature of the lower sheet metal face is in each case always greater than or equal to a predetermined limit temperature, especially 350° C. A surface temperature of the sheet metal is preferably used as the limit temperature. The level of the limit temperature is for example defined such that the cooling effect principle is the same for the entire cooling section. If the cooling effect principle for the sheet metal alters while the sheet metal is passing through the cooling section, the cooling becomes difficult to manage. For this reason there is provision for operating the cooling section such that the limit temperature of neither the upper face of the sheet metal nor the lower face of the sheet metal is undershot during the passage through the cooling section. In this method the predetermined limit surface temperature is simply taken into account as an ancillary condition in determining the respective flow of heat.

Some embodiments provide a method for cooling sheet metal by means of a cooling section, wherein the cooling section has a plurality of coolant dispensing devices for cooling an upper sheet metal face and a plurality of coolant dispensing devices for cooling a lower sheet metal face, wherein by means of the cooling a predetermined target state of the sheet metal is achieved at least at and/or after exit from the cooling section, wherein a coolant dispensing is determined for at least one of the coolant dispensing devices, wherein, on determination of the coolant dispensing for at least one of the cooling devices, account is taken of the fact that that face of the sheet metal which faces the coolant dispensing device, especially while the cooling is being carried out, always has a temperature greater than or equal to a predetermined limit temperature.

Regardless of the manner in which a sheet metal is cooled in a cooling section, entering a temperature range of the sheet metal in which the cooling mechanism of the cooling section changes is to be avoided. The cooling mechanism is as a rule determined by the behavior of the coolant on the sheet metal, e.g. formation of vapor pillows for water cooling, the manner of the distribution of the vapor on the sheet metal etc. If, as a result of the temperature curve of the surface of the sheet metal there is a change in the behavior of the coolant of the sheet metal and thereby a change in the cooling mechanism, this leads to the cooling becoming difficult to manage and thus to a product which does not generally meet the customer's requirements. For example this is especially the case on the upper face if, away from the direct point of action or immediately in the vicinity of the jet of cooling medium, any superfluous coolant flowing off on the upper face is no longer separated from the surface of the sheet metal by a vapor layer, but moves in a liquid phase unchecked over the sheet metal and in doing so gradually evaporates.

In particular a non-flat product can be produced if the cooling mechanism changes, since the flow of heat, because of the change to the cooling mechanism, especially on the upper sheet metal face, is difficult to calculate and difficult to predict. This results in corresponding temperature fluctuations which cause material stresses. These lead to the sheet metal warping and becoming non-flat.

This problem may be avoided by taking account of a limit temperature in determining the coolant dispensing, through which the flatness of the plate is improved with a simultaneously high throughput.

Some embodiments provide a control and/or regulation device for a rolling train, with a machine-readable program code comprising control commands which, when executed, cause the control and/or regulation device to carry out any of the methods disclosed herein.

Other embodiments provide a machine-readable program code for a control and/or regulation device for a cooling section, wherein the program code comprises control commands which cause the control and/or regulation device to execute any of the methods disclosed herein. Other embodiments provide a storage medium storing such a machine-readable program code. All storage media on which the corresponding program code is able to be stored can be considered as storage media, for example these can be CDs, DVDs, flash storage media such as USB sticks or memory cards.

Other embodiments provide a cooling section for cooling sheet metal, wherein the cooling section has a plurality of coolant dispensing devices for cooling an upper sheet metal face and a plurality of coolant dispensing devices for cooling a lower sheet metal face, wherein the cooling section is actively connected to a control and/or regulation device as disclosed herein, wherein the coolant dispensing devices are able to be controlled and/or regulated by the control and/or regulation device. This provides a cooling section by means of which the flatness of the sheet metal to be cooled is improved.

FIG. 1 shows a typical cooling section 1 for cooling hard plate B. This is part of a hard plate train not shown in any greater detail.

The cooling section 1 comprises a plurality of coolant dispensing devices 2, which are disposed both above and also below the sheet metal B. Their coolant dispensing is able to be set individually, which allows the greatest possible flexibility and dynamics of the cooling section 1.

Frequently each coolant dispensing device 2 of the cooling section 1 is assigned a coolant dispensing device 2 directly opposite it. If these coolant dispensing devices disposed directly opposite one another are in operation, they are each cooling the same section of sheet metal. The coolant dispensing device 2 disposed above the sheet metal cools an upper side O of the sheet metal section, while the coolant dispensing device 2 disposed below the sheet metal B cools a lower side U of the sheet metal section.

The cooling section 1 also has a flatness measuring device 3 disposed in front of it in the mass flow direction, by means of which a flatness of the sheet metal B entering the cooling section 1 can be detected.

In the present exemplary embodiment the cooling section 1 also has two temperature measurement devices 4 or 5 disposed in front of it, of which the temperature measurement device 4 disposed above the sheet metal B measures the temperature of the upper sheet metal face O and the temperature measurement device 5 disposed below the sheet metal B measures the temperature of the lower sheet metal face U. As an alternative the temperature of upper sheet metal face O and/or of lower sheet metal face U can be determined by means of a model before entry into the cooling section 1. Since as a rule the sheet metal B is divided up for calculation purposes into a plurality of sheet metal sections and each of these sheet metal sections can be traced in the calculations, the actual temperature of the upper sheet metal face and/or of the lower sheet metal face can be determined for a respective sheet metal section at a predeterminable reference point before the cooling sections. In this manner, the temperature measurement devices 4, 5 before the cooling section 1 can be entirely or partly dispensed with. In the event of only one temperature measurement, e.g. a temperature measurement on the upper face, being available, the temperature distribution over the thickness of the sheet metal calculated by a model temperature is initially adapted such that measured and calculated temperature on the measurement side match. The calculated value on the opposite side, on which the measurement is missing, can then be taken from this model.

The cooling section also has a temperature measurement device 6 which is disposed in the mass flow direction after the cooling section 1. These temperature values detected after the cooling section 1 can be included, e.g. within the framework of a model adaptation, for correcting the calculation of the coolant dispensing.

The coolant dispensing device 2, the temperature detection devices 4, 5 or 6, and the flatness measurement device 3 is or are actively connected to a control and/or regulation device. The operation of the cooling section 1, especially the coolant dispensing, is controlled or regulated by means of the control and/or regulation device 10. Therefore the corresponding calculation procedures for determining the coolant dispensing are stored on this control and/or regulation device 10.

In particular the control and/or regulation device 10 includes machine-readable program code 12. This comprises control commands which cause the control and/or regulation device 10 to carry out a form of execution of the method disclosed herein. The machine-readable program code 12 is typically stored on a storage medium 11, such as a CD, a DVD, a flash storage device, e.g. a USB stick, or other data carriers. As an alternative the machine-readable program code 12 can be supplied to the control and/or regulation device 10 via a network.

In particular the machine-readable program code 12 is stored on a storage medium which is part of the control and/or regulation device 10.

Methods are described below that are able to be advantageously executed with a cooling section 1 configured in this way.

Figure 2:
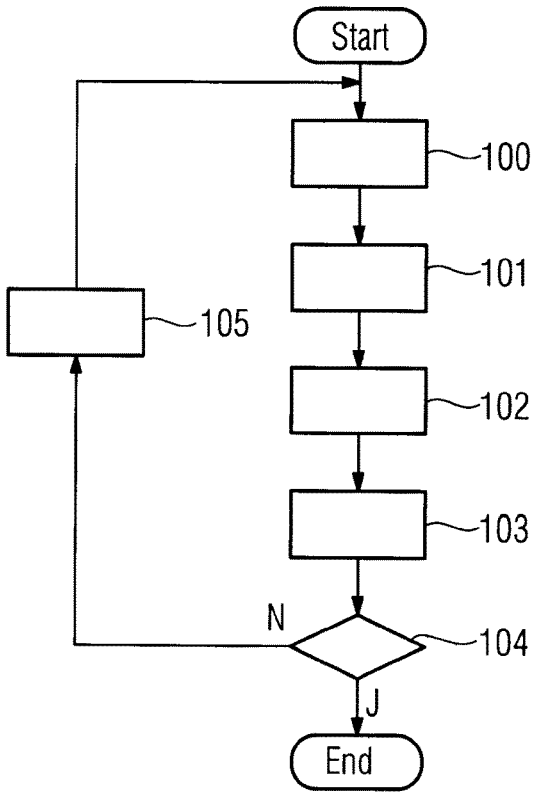
FIG. 2 shows a diagram for determining coolant dispensing for a coolant dispensing device based on an equation system.

FIG. 2 shows a flow diagram, in accordance with which the coolant dispensing, especially the quantity of coolant to be dispensed per unit of time, is determined for a pair of coolant dispensing devices disposed directly opposite one another.

In a method step 100 the temperature To of the upper sheet metal face and the temperature Tu of the lower sheet metal face are determined. This can typically be done by means of a measurement, as in FIG. 1, or alternatively these temperatures can be determined from the model calculations running at the same time.

In a method step 101, on the basis of the desired target state of the sheet metal after the cooling section, a total flow of heat is determined which is required to transfer the sheet metal from its known initial state before the two opposing coolant dispensing devices into a desired end state after the two opposing coolant dispensing devices, e.g. to a desired initial state before the two next opposing coolant dispensing devices or the cooling stop temperature. The fact that the temperature of the upper sheet metal face and of the lower sheet metal face is known means that this can be done with increased accuracy.

This produces an overall flow of heat for each pair of coolant dispensing devices arranged opposite one another, which is to be dissipated by this pair so that the desired end state of the sheet metal can be reached.

This required overall flow of heat is now to be distributed to the individual coolant dispensing device pairs, with account being taken of the fact that a predetermined limit temperature of the upper sheet metal face and of the lower sheet metal face may not be undershot. Account is also taken of the fact that the flow of heat to be dissipated is strongly temperature-dependent. Account is also taken of the flatness of the sheet metal before it enters the cooling section.

To this end, first of all, in a method step 102 for example, a numerical value x, $0<x<1$, is determined as a function of a measured flatness value of the sheet metal. This can be done by means of the table for example which, for a given measured flatness value, contains a matching value for x e.g. x=0.5 for flat sheet metal, x=0.6 for sheet metal which is curved slightly upwards x=0.4 for sheet metal which is curved slightly downwards.

Then in method step 103 the total heat flow $j_{tot}$ determined in method step 101 is distributed to the two coolant dispensing devices. From the total heat flow $j_{tot}$ determined in method step 101, first of all the heat flows of the upper side, $j_{upper}$ and the lower side, $j_{lower}$ are calculated by means of the equation $$0=x\cdot j_{upper}-(1-x)\cdot j_{lower}$$

and $$j_{tot}=j_{upper}+j_{lower}$$

In these equations x is the constant calculated in step 102. Then a check is made by means of the model as to whether the temperature is less than the predetermined limit temperature of the upper sheet metal face and of the lower sheet metal face. If this is not the case the method can continue immediately with step 103, with a=1. If this is the case, a number a, 0<a<1, is calculated, such that when the heat flows $aj_{upper}$ instead of $j_{upper}$ and/or $aj_{lower}$ instead of $j_{lower}$ are used for the largest possible value of a, this limit temperature is still just adhered to. The method then continues with these heat flows with step 103.

From this the quantities of coolant for the coolant dispensing device above the sheet metal and below the sheet metal can be determined for the respective pair of coolant dispensing devices. This is done in a method step 104.

If for example a flat sheet metal enters the cooling section, taking into account the different temperatures of the upper sheet metal face and of the lower sheet metal face, the flow of heat is set such that the same flow of heat is dissipated from the upper sheet metal face and lower sheet metal face. This namely requires that the temperature of upper sheet metal face and lower sheet metal face is generally different, a change of the quantity of coolant for the coolant dispensing device arranged above the sheet metal and for the coolant dispensing device arranged below the sheet metal compared to the quantities of coolant is determined in accordance with conventional techniques. An even cooling is however only possible if the flow of heat on upper sheet metal face and lower sheet metal face is the same, which is achieved by a procedure in accordance with one of the embodiments of the method disclosed herein.

It might be that explicit uneven cooling of upper sheet metal face and lower sheet metal face is desired, for example if the sheet metal is already not flat when it enters the cooling section. This is detected by means of the flatness measuring device. The result of the flatness measuring is thus included in the further operation of the cooling section, wherein the cooling is adapted such that the non-flatness of the sheet metal is counteracted.

A further reason for an unequal setting of the flow of heat for upper sheet metal face and lower sheet metal face can also be too great a temperature difference between upper sheet metal face and lower sheet metal face. In cooling methods currently known this can lead to parts of the sheet metal not being flat in the cooling section. For example with temperature differences between upper sheet metal face and lower sheet metal face that are too great it can no longer be possible to cool the sheet metal in such a way that the surface temperature always remains above a limit temperature but at the same time a greater heat dissipation is required to obtain a flat sheet metal, which also reaches the desired target state. The explicit uneven distribution of the flow of heat between upper sheet metal face and lower sheet metal face is suitable for reducing these types of temperature differences and manufacturing a flat sheet metal.

This process is undertaken in this way for all coolant dispensing devices lying opposite one another. Whether this is to occur for further coolant dispensing devices disposed opposite one another will be interrogated in each case in a method step 105.

If for example a final state of the sheet metal is reached without further cooling, no further interrogation for a further coolant quantity determination for subsequent coolant dispensing devices in the mass flow direction is required. Such an interrogation step can be provided between method step 103 and method step 104. This avoids further calculation cycles, the result of which is already fixed beforehand, namely that the quantity of coolant to be dispensed in these cases is equal to zero.

Thus, for the required pairs of coolant dispensing devices, an individual quantity of coolant to be dispensed by the respective coolant dispensing device is determined which ensures that the target state of the sheet metal is reached while adhering to corresponding peripheral conditions.

Subsequently the coolant dispensing devices of the cooling section are set in the above manner so that the desired end state of the sheet metal is reached.

Figure 3:
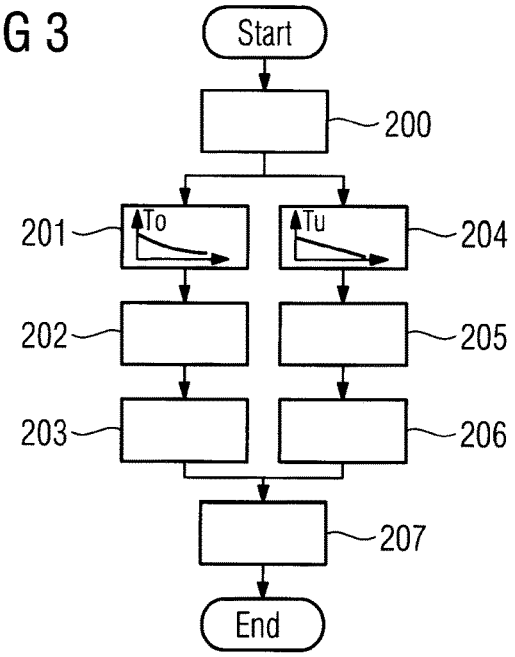
FIG. 3 shows a flow diagram for determining coolant dispensing for a coolant dispensing device based on a separate determination for upper sheet metal face and lower sheet metal face.

An alternative procedure for determining coolant dispensing is shown schematically in FIG. 3.

In accordance with FIG. 3 a calculation method is used for determining the coolant dispensing for the coolant dispensing devices above and below the sheet metal, which determines the coolant dispensing or quantities separately for upper sheet metal face and lower sheet metal face. To this end the sheet metal is divided for calculation purposes into an upper and a lower sheet metal, wherein an exchange of heat between this upper and lower sheet metal is ignored.

In a method step 200 first of all for example, depending on the flatness value of the sheet metal, a numerical value x, 0<x<1, is determined. This can be done by means of the table for example which, for a given measured flatness value, contains a matching value for x e.g. x=0.5 for flat sheet metal, x=0.6 for sheet metal which is curved slightly upwards x=0.4 for sheet metal which is curved slightly downwards. Subsequently the sheet metal is divided virtually at level x into an upper sheet metal and a lower sheet metal. In this case x means the ratio of the thickness of the lower sheet metal relative to the total thickness. The sheet metal is divided virtually at level x multiplied by sheet metal thickness, measured from the underside of the sheet metal upwards.

In a method step 200 the temperature of the upper sheet metal face and of the lower sheet metal face before the cooling section are determined. From this and in the knowledge of the temperature curve in the thickness direction of the sheet metal an average temperature for the upper sheet metal and an average temperature for the lower sheet metal are determined.

In a method step 201 an average temperature curve over time for a specific sheet metal section of the sheet metal is predetermined for the upper sheet metal for example, so that this is transferred from a known average starting temperature before the beginning of cooling to an average desired end temperature. This is done in a similar way for the lower sheet metal in a method step 204. The predetermined temperature curves because of the different starting temperature and the different coolant ratio on upper sheet metal face and lower sheet metal face are generally different. However the final state to be reached is generally the same for the upper and the lower sheet metal.

As an alternative to a temperature curve over time, a local temperature curve for the two sheet metals can be predetermined. Also conceivable is predetermining a temporal or local enthalpy curve for the upper and lower sheet metal, so that the sheet metal reaches a desired end state.

In a method step 202 or 205 a respective flow of heat for the upper or lower sheet metal which is required to set the desired curve for the upper sheet metal or the lower sheet metal respectively is determined from the respective predetermined curve. This is done with the usual physical equations which describe the temperature development and the thermal transfer.

In a method step 203 or 206 the respective coolant dispensing, especially the quantity of coolant per unit of time, is determined for the upper sheet metal and the lower sheet metal from the heat flows determined for the coolant dispensing device disposed above the sheet metal and for the coolant dispensing device disposed below the sheet metal.

In a method step 207 the coolant dispensing devices of the cooling section are set accordingly in the above manner, so that the desired end state of the sheet metal is reached.

Figure 4:
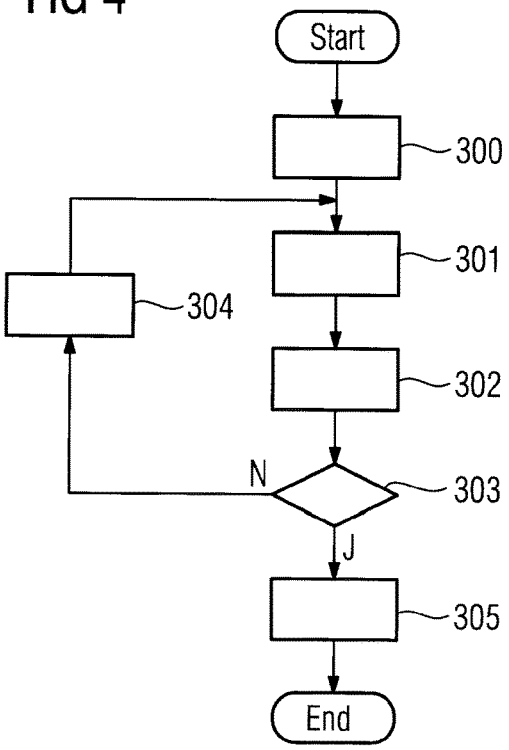
FIG. 4 shows a flow diagram for determining coolant dispensing taking into account a limit temperature.

FIG. 4 shows a flow diagram, which in a determination of coolant dispensing for a coolant dispensing device, takes account of a limit temperature. Taking account of such a limit temperature may be very advantageous because—depending on the coolant used—the cooling effect very much depends on the coolant behavior. The behavior of the coolant can change for example because of the temperature of the sheet metal metal.

When the water is used it can be observed that the behavior of the cooling water changes for example at sheet metal surface temperatures of below 350° C. The Leidenfrost effect comes into play. The result of this is that especially on the upper side of the strip, the cooling effect of the water and thus the cooling of the sheet metal can barely be managed any longer. On the underside the effect is not as strong since there surplus coolant can simply drop down from the surface. On the other hand a high cooling power, i.e. a high amount of coolant per unit of time, can be required for reaching a desired state of the sheet metal.

However this leads to much more heat being dissipated from the surface than can flow outwards to replace it from the inside of the sheet metal. The result is a strong cooling at the surface of the sheet metal combined with a high temperature gradient in the thickness direction of the sheet metal. If the temperature at the surface falls below a critical level this leads as a rule to a non-flatness of the sheet metal.

Frequently this non-flat sheet metal is to be seen as production scrap and is no longer able to be used. Furthermore there is a danger of parts of the system being damaged.

To avoid this, the coolant can be dispensed taking into account a limit temperature below which the temperature must not be allowed to fall during the cooling at least on the upper sheet metal face, if necessary also on the lower sheet metal face.

In a method step 300 the temperature of the upper sheet metal face and/or the temperature of the lower sheet metal face is determined. This can be done on the basis of the model, as described above, or by means of a measurement.

The coolant dispensing can be determined in accordance with any given method, preferably in accordance with one of the methods outlined above. This occurs in accordance with FIG. 4 in a method step 301.

In a method step 302 a surface temperature is calculated in advance which is set if the quantity of coolant per unit of time calculated in accordance with method step 301 is applied to the surface of the sheet metal or sheet metal section respectively.

Adherence to the limit temperature is checked in a method step 303.

If the temperature of the surface of the sheet metal set by the application of the coolant falls below the limit temperature, the cooling power is for example redistributed to coolant dispensing devices following the mass flow direction or is reduced in a method step 304.

Subsequently coolant dispensing is determined once again based on the redistributed or reduced cooling power, in accordance with method step 301. This produces a new surface temperature which is compared with the limit temperature. If said surface temperature is still below the limit temperature, cooling power is redistributed or reduced until such time as the temperature adheres to the limit temperature.

In the redistribution or reduction of cooling power the temperature of the sheet metal is preferably included in the calculation and it is established how the cooling power of the subsequent coolant dispensing devices is to be set in order for example to dissipate a desired flow of heat, adhere to the limit temperature and reach the desired end state.

The redistribution of the cooling power to subsequent coolant dispensing devices in such cases has the effect on the one hand of adhering to the limit temperature, on the other hand of reaching the target state of the sheet metal after it is passed through cooling.

Checking for adherence to the limit temperature can be undertaken in each case successively, i.e. gradually for each coolant dispensing device separately, or for the entire cooling section in sum.

In a method step 305 the coolant dispensing determined in accordance with the above method is set in the cooling section.

Preferably this method is carried out online, i.e. during the cooling of heavy plate, so that the cooling process is optimized in real time and accordingly no scrap is created by undershooting the limit temperature.

As an alternative, coolant dispensing, especially the quantity of coolant to be dispensed per unit of time, is already determined before the entry of the sheet metal into the cooling section such that the limit temperature is already taken into account here and this is not undershot. This is less time-intensive, since no closed-loop controls are necessary. The calculated coolant dispensing is then applied at the correct times as the sheet metal passes through the cooling section.

What is claimed is:

1. A method for cooling sheet metal using a cooling section, wherein the cooling section has a first plurality of coolant dispensing devices for cooling an upper sheet metal face and a second plurality of coolant dispensing devices for cooling a lower sheet metal face, the method comprising:

determining an actual temperture of at least one of the upper and lower sheet metal faces, determining a target temperture of at least one of the upper and lower sheet metal faces, determining a total flow of heat to be dissipated from the sheet metal based on (a) the at least one actual temperture of the sheet metal and (b) the at least one target temperture of the sheet metal, measuring a flatness of the sheet metal prior to cooling the sheet metal by the coolant dispensing devices, calculating from the total flow of heat to be dissipated from the sheet metal (i) a first portion of the total flow of heat, which first portion is to be dissipated from the upper sheet metal face and (ii) a second portion of the total flow of heat, which second portion is to be dissipated from the lower sheet metal face as a function of (a) the determined actual temperture of the at least one of the upper and lower sheet metal faces, and (b) the measured flatness of the sheet metal, and determining a quantity of coolant to be dispensed by the first coolant dispensing devices based at least on the calculated first portion of the total flow of heat to be dissipated from the upper sheet metal face, determining a quantity of coolant to be dispensed by the second coolant dispensing devices based at least on the calculated second portion of the total flow of heat to be dissipated from the lower sheet metal face, and dispensing the determined quantities of coolant by the first and second coolant dispensing devices to the upper and lower sheet metal faces, respectively.

2. The method of claim 1, comprising:

setting a ratio of (a) the flow of heat to be dissipated from the upper sheet metal face to (b) the flow of heat to be dissipated from the lower sheet metal face as a function of the measured flatness of the sheet metal, and determining the flow of heat to be dissipated from each of the upper and lower sheet metal faces as a function of the set ratio.

3. The method of claim 2, wherein for a sheet metal that is flat on its entry into the cooling section, the ratio is essentially equal to one.

4. The method of claim 2, wherein for a sheet metal that is not flat on entry into the cooling section, the ratio is set such that the non-flatness of the sheet metal after its passage through the cooling section is reduced relative to the non-flatness of the sheet metal before its passage through the cooling section.

5. The method of claim 1, wherein the coolant is dispensed by the first and second coolant dispensing device based on the equation:

$$0=x\cdot j_{upper}-(1-x)\cdot j_{lower}$$

and $$j_{tot}=j_{upper}+j_{lower}$$

wherein x: is a predeterminable factor greater than 0 and less than 1, $j_{upper}$: is a flow of heat to be dissipated from the upper sheet metal face, $j_{lower}$: is a flow of heat to be dissipated from the lower sheet metal face, and $j_{tot}$: is a total flow of heat to be dissipated and predetermined.

6. The method of claim 1, wherein, for at least one of the first and second coolant dispensing devices, the coolant is dispensed independently of the coolant dispensing of another coolant dispensing device.

7. The method of claim 6, wherein the determination is undertaken such that the sheet metal is essentially divided in parallel to the upper face or the lower face into a first sheet metal and a second sheet metal, wherein the coolant dispensing is determined separately for the first and the second sheet metal, wherein for the respective determination the exchange of heat between the first sheet metal and the second sheet metal is ignored.

8. The method of claim 7, comprising:

determining for each of the first sheet metal and the second sheet metal an individual timing curve for a variable describing an energetic state of the sheet metal, and determining a flow of heat to be dissipated for the respective upper sheet metal face and the lower sheet metal face based at least on the respective individual timing curve.

9. The method of claim 1, wherein, the determination of the coolant dispensings for the first and second coolant dispensing devices utilize an assumption that a temperature of the upper sheet metal face and a temperature of the lower sheet metal face remain greater than or equal to a predetermined limit temperature during its passage through the cooling section.

10. A method for cooling sheet metal using a cooling section, wherein the cooling section has a first plurality of coolant dispensing devices for cooling an upper sheet metal face and a second plurality of coolant dispensing devices for cooling a lower sheet metal face, the method comprising:

cooling the sheet metal to reach a predetermined target state of the sheet metal at least during or after exiting the cooling section, by:

determining at least one actual temperture of the sheet metal, determining a total flow of heat to be dissipated from the sheet metal based at least on (a) the determined at least one actual temperture of the sheet metal and (b) the predetermined target state of the sheet metal, measuring a flatness of the sheet metal prior to cooling the sheet metal by the coolant dispensing devices, determining a flatness-related distribution ratio based on the measured flatness of the sheet metal, distributing the determined total flow of heat to be dissipated from the sheet metal into (a) a flow of heat to be dissipated from the upper sheet metal face and (b) a flow of heat to be dissipated from the lower sheet metal face, based at least on the determined flatness-related distribution ratio that is determined based on the measured flatness of the sheet metal, determining a quantity of coolant to be dispensed by the first coolant dispensing devices based on the predetermined target state of the sheet metal and the flow of heat to be dissipated from the upper sheet metal face, determining a quantity of coolant to be dispensed by the second coolant dispensing devices based on the predetermined target state of the sheet metal and the flow of heat to be dissipated from the lower sheet metal face.

11. The method of claim 1, comprising, for each of the first and the second coolant dispensing devices, predetermining the flow of heat to be dissipated from the side of the sheet metal facing the respective coolant dispensing device based at least on a surface temperature of the respective side of the sheet metal.

12. The method of claim 1, wherein, for at least one of the first and second coolant dispensing devices, the coolant is dispensed independently of the coolant dispensing of another coolant dispensing device lying opposite the respective cooling device relative to the sheet metal.

13. The method of claim 1, wherein, the determination of the coolant dispensings for the first and second coolant dispensing devices utilize an assumption that a temperature of the upper sheet metal face and the lower sheet metal face remains greater than or equal to 350 degrees Celsius during its passage through the cooling section.

* * * * *